United States Patent [19]

Moore et al.

[11] Patent Number: 4,808,072

[45] Date of Patent: Feb. 28, 1989

[54] ELECTRICAL GROUNDING CONNECTOR FOR A HELICOPTOR ROTOR

[75] Inventors: Thomas A. Moore, Monroe; Stanley J. Bazydola, Jr., Fairfield; Richard A. Depietro, East Hartford, all of Conn.

[73] Assignee: United Technologies Corporation, Hartford, Conn.

[21] Appl. No.: 97,993

[22] Filed: Sep. 17, 1987

[51] Int. Cl.[4] ..... H01R 4/66

[52] U.S. Cl. ..... 416/5; 174/6; 439/98

[58] Field of Search ..... 439/1, 2, 95–100; 416/158, 5, 155; 174/6, 78

[56] References Cited

U.S. PATENT DOCUMENTS 4,320,252 3/1982 Holman et al. ..... 174/78

4,424,947 1/1984 Adams et al. ..... 439/2

FOREIGN PATENT DOCUMENTS 2090214 7/1982 United Kingdom ..... 416/158

*Primary Examiner*—Gil Weidenfeld

*Assistant Examiner*—Gary F. Paumen

[57] ABSTRACT

An electrical grounding connector for a helicopter rotor hub (15) comprises a bushing (25) which receives a hollow spindle (30) therewithin. Spindle (30) accommodates a cable or wire harness (35) therewithin and is rotatable within the bushing to accommodate twisting of the harness due to displacement of the helicopter blades. An electrical connection to hub (15) is made via flexible conductor (75), the spindle, and flexible conductor (60).

6 Claims, 2 Drawing Sheets

ELECTRICAL GROUNDING CONNECTOR FOR A HELICOPTOR ROTOR

CROSS REFERENCE

This invention was made with Government support under a contract awarded by the Deparement of the Navy. The Government has certain rights in this invention.

TECHNICAL FIELD

This invention relates to a connector for mechanically mounting and electrically grounding a cable or wire harness to a helicopter rotor hub.

BACKGROUND ART

Modern helicopters, particularly military helicopters such as those operated from shipboard, include electrical apparatus such as lamps, actuators, and heaters on the rotors (blades) thereof for such functions as blade tip lighting, folding and deicing, respectively. It is, therefore, necessary to provide electrical connections to such apparatus by means of cables (wire harnesses) which connect the apparatus to sources of electrical power as well as control equipment such as flight control computers and the like. Typically, such cables are routed from the exterior of the rotor or the helicopter's blades to the interior of the rotor hub and then to a slip ring or equivalent electrical connector for ultimate connection to the controller or power source. Since helicopter blades experience various modes of displacement such as twisting, flapping and lead-lag (in-plane) modes, it has been the practice to restrain the cables within the rotor hub in a manner which allows for limited movement of the cables due to such blade displacements. However, it has been determined that mechanically, such schemes for restraining a cable within the interior of a rotor hub could be improved upon, particularly in a way which would allow convenient electrical grounding of the cable to the rotor hub, thereby preventing damage to connected control equipment from harsh electromagnetic environments, short circuits or other electrical malfunctions.

DISCLOSURE OF INVENTION

In accordance with the present invention, a cable or wiring harness is effectively grounded to the interior of a helicoptor rotor hub by a connector which permits limited rotation (twisting) of the cable about its own longitudinal axis to accommodate cable movement associated with rotor blade displacements. The connector comprises a bushing fixed to the interior or the rotor hub and a hollow spindle rotatably received within the bushing. The cable is received within, and fixed to the interior of the spindle by means such as a bonding material (epoxy resin or the like), whereby the spindle rotates freely within the bushing with the rotation or twisting of the cable. An electrical conductor connect at one end thereof to the cable interiorly of the bonding material, thereby ensuring protection of the electrical connection from contamination. The other end of the conductor is attached to an end portion of the spindle by a clamp or the like. An electrical connection between the spindle and the interior of the rotor hub is provided by a second flexible conductor attached to those components as by a threaded or equivalent fasteners. With the rotor hub of the present invention, effective grounding of the wire harness from the blades is achieved in a manner which freely accommodates twisting of the harness due to blade displacements resulting from normal operation of the helicopter.

BEST MODE FOR CARRYING OUT THE INVENTION

Figure 1:
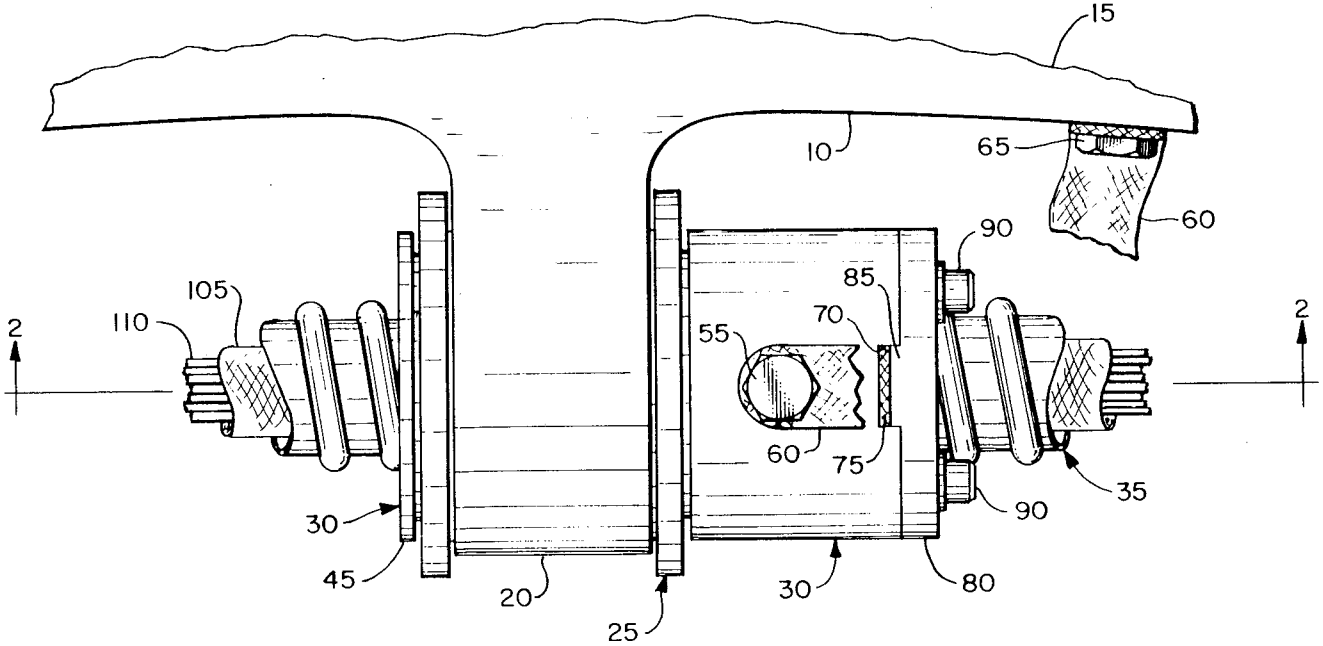
FIG. 1 is a top plan view of the helicopter rotor hub connector of the present invention.
Figure 2:
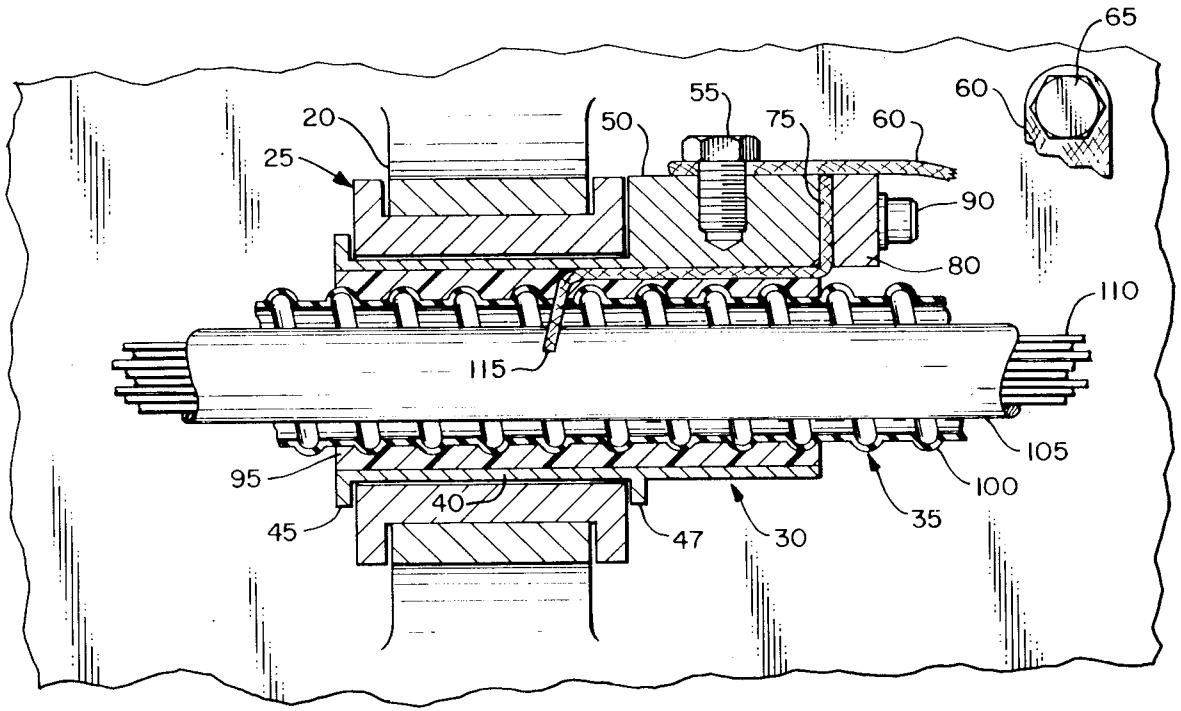
FIG. 2 is a sectioned elevation of the connector of the present invention taken in the direction of line 2—2 of FIG. 1.

Referring to the drawings, the interior surface 10 of a helicopter rotor hub 15 is provided with a lug 20 thereon, the lug being formed integrally with the hub (as illustrated) or attached thereto by any suitable means. A hollow flanged bushing 25 is received within lug 20, being retained thereby the engagement of the flanges with the side surfaces of the lug. As illustrated, the flanges may be formed integrally with the bushing, (in which case the lug may be bifurcated for ease of assembly of the bushing therewithin).

A hollow spindle 30 is rotatably received within the bushing and accommodates a jacketed cable or wire harness 35 therewithin. Spindle 30 comprises a reduced diameter medial portion 40 rotatably received within bushing 25, end flanges 45 and 47 and an enlarged end portion 50 which, with the flanges, maintains the longitudinal position of the spindle with respect to bushing 25. Enlarged end portion 50 is drilled and tapped to receive bolt 55 which serves to electrically connect flexible conductor 60 to the enlarged end of spindle 30. The opposite end of flexible conductor 60 is electrically grounded to rotor hub 15 by bolt 65 threaded into the interior of the hub.

The outer end face of enlarged end portion 50 is slotted at 70 (FIG. 1) to receive flexible conductor 75 therewithin. Conductor 75 is clamped to end portion 50 (within slot 70) by a jaw 80 having an integral tooth 85. Jaw 80 is fixed to the spindle by means of bolts 90. Spindle 30 is filled with a bonding material 95 such as epoxy resin or the like which firmly secures cable 35 within the spindle.

Cable 35 comprises an outer insulating jacket 100, an intermediate grounding sheath 105 and a plurality of insulated wires 110 received therewithin. Conductor 75 is electrically connected to the grounding sheath at 115 interiorly of bonding material 95 whereby the connection is protected by the bonding material from water or other contaminants.

It will be appreciated that the helicopter rotor hub connector of the present invention provides an effective means for grounding a cable or wire harness to the interior of a rotor hub while mechanically attaching the harness to the rotor hub in a manner which accommodates harness movement due to blade displacements. The bonding material within spindle 30 efectively seals the electrical connection of the harness to spindle 30 from contamination thereof. The bonding material also firmly secures the harness within the spindle, whereby twisting the harness will in turn cause rotation of the spindle which is freely accommodated by bushing 25. Flexible conductor 60, being bolted to the spindle and rotor hub provides an electrically and mechanically secure ground connection from the spindle to the rotor hub, which connection freely accommodates rotation of the spindle due to twisting of the wire harness. Moreover, abrasion or other mechanical wear of the harness is essentially eliminated by the rotatable support which the connector offers. In the event of wear in flexible conductor 60, this component is readily replaceable without significant disassembly of the connector or harness.

While a specific embodiment of the present invention has been illustrated and described, it will be readily appreciated that various modifications may be made to the rotor hub connector of the present invention without departing therefrom. It is intended by the following claims to cover all such modifications as fall within the true spirit and scope of this invention.

Having thus described the invention, what is claimed is:

1. A helicopter rotor hub characterized by:

a connector for providing twistable support of a cable within said hub and an electrical ground connection from said cable to said rotor hub, said connector comprising:

a bushing fixedly attached to the interior of said rotor hub;

a hollow conductive spindle which receives said cable therewithin, said spindle being rotatably received within said bushing to accommodate twisting of said cable;

means disposed interiorly of said spindle for fixing said cable thereto;

an electrical conductor, said electrical conductor at one end thereof being electrically connected to said cable; and means for connecting an opposite end of said conductor to said spindle for ultimate electrical connection of said cable to said rotor hub.

2. The connector of claim 1 characterized by said fixing means comprising a bonding material.

3. The connector of claim 1 characterized by said electrical conductor being connectable to said cable, interiorly of said bonding material, whereby said bonding material seals the connection of said conductor to said cable from contamination.

4. The connector of claim 1 characterized by said connecting means comprising a clamp.

5. The connector of claim 4 characterized by said conductor being connected to said spindle at an enlarged end thereof which includes a slot therein, said clamp comprising a jaw having a tooth receivable in said slot for restraining said electrical conductor against the interior thereof.

6. The connector of claim 5 characterized by said spindle including a flange at an end thereof opposite said enlarged end, said bushing being disposed between said flange and said enlarged end portion for maintenance of the relative longitudinal positions of said spindle and said bushing

* * * * *

UNITED STATES PATENT AND TRADEMARK OFFICE

CERTIFICATE OF CORRECTION

PATENT NO. : 4,808,072

DATED : Feb. 28, 1989

INVENTOR(S) : Thomas A. Moore, et al.

It is certified that error appears in the above-identified patent and that said Letters Patent is hereby corrected as shown below:

In Column 1, line 7, change "a contract" to read --Contract N00019-84-C-0352-

Signed and Sealed this

Twenty-fourth Day of June, 1997

Bruce Lehman

*Attest:*

BRUCE LEHMAN

*Attesting Officer*

*Commissioner of Patents and Trademarks*